United States Patent [19]

Noren

[11] 4,257,559

[45] Mar. 24, 1981

[54] REMOVABLE AND SELF SEALING SPRAY MANIFOLD FOR COMMERCIAL DISHWASHER

[76] Inventor: Tore H. Noren, Petaluma, Calif. 94952

[21] Appl. No.: 62,294

[22] Filed: Jul. 31, 1979

[51] Int. Cl.[3] ..... B05B 15/06

[52] U.S. Cl. ..... 239/283; 239/566; 239/567; 239/600

[58] Field of Search ..... 239/566, 567, 568, 282, 239/283, 600; 285/334.5, DIG. 2; 138/89

[56] References Cited

U.S. PATENT DOCUMENTS

| | | | |
|---|---|---|---|
| 1,943,496 | 1/1934 | Thompson | 285/334.5 X |
| 3,182,669 | 5/1965 | Campbell | 239/567 X |

*Primary Examiner*—Richard A. Schacher
*Attorney, Agent, or Firm*—Alvin E. Hendrickson; William R. Piper

[57] ABSTRACT

A removable and self sealing spray manifold that has an unobstructed cylindrical interior extending throughout its entire length. Novel self sealing and manifold supporting means is provided at each end of the manifold. The rear end supporting means for the manifold connects the manifold to a hot water inlet pipe and includes means for correctly positioning the spray nozzles for directing the hot water against the ware in the racks. The means for supporting the front manifold end includes a self-sealing cap that can be removably connected to the manifold without the need of using any tools.

5 Claims, 6 Drawing Figures

FIG. 1.
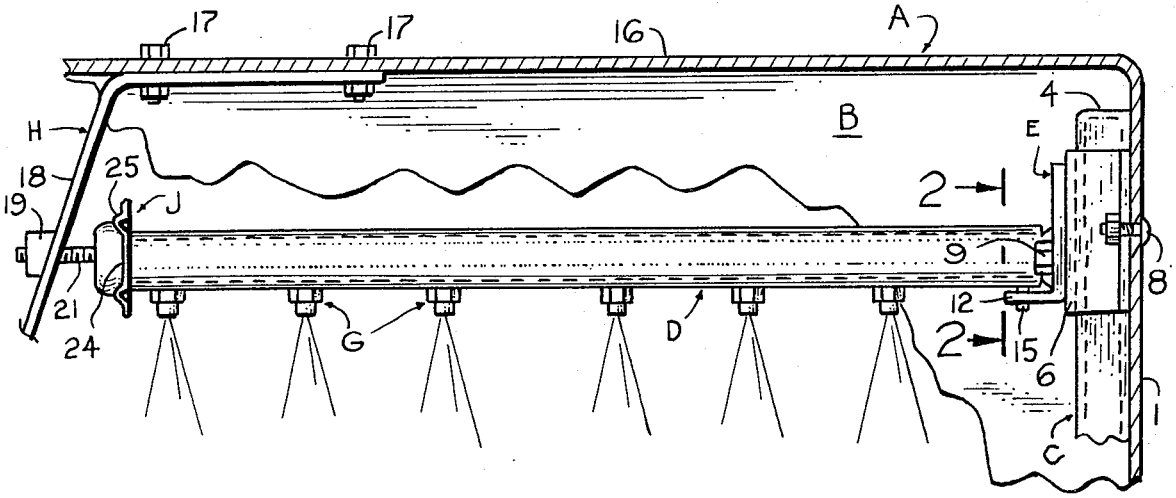
FIG. 2.
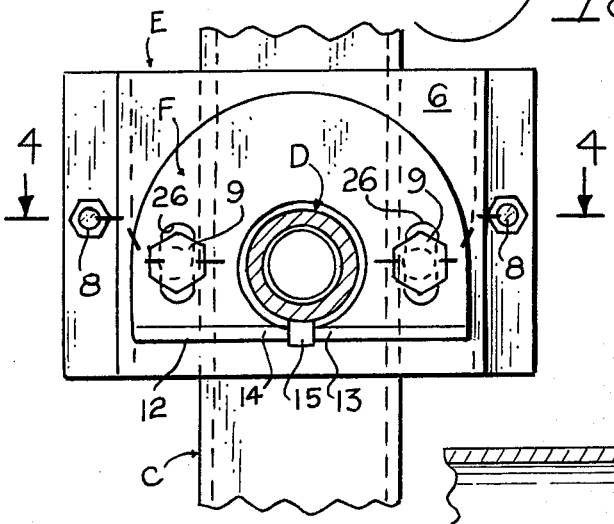
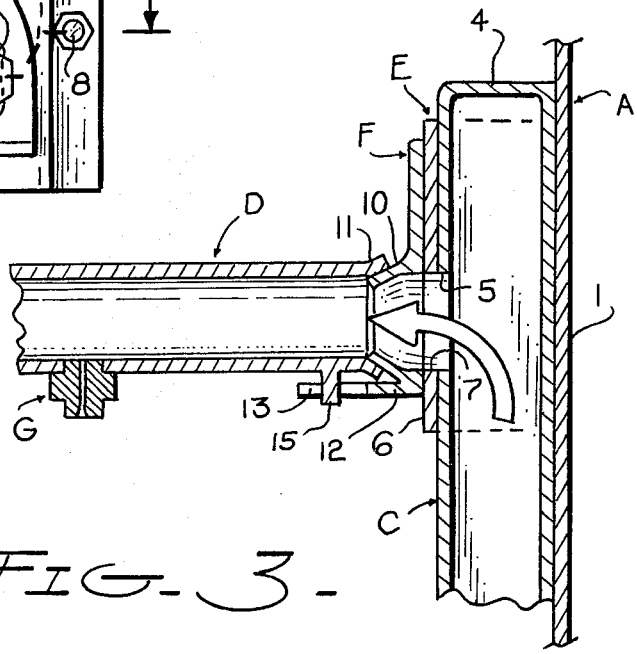
FIG. 3.

REMOVABLE AND SELF SEALING SPRAY MANIFOLD FOR COMMERCIAL DISHWASHER

SUMMARY OF THE INVENTION

An object of my invention is to provide a spray manifold for a commercial dishwasher that can be quickly mounted in the machine without the need to use any tools and novel means supports both ends of the hollow manifold, one end being connected to a hot water supply and the other end being supported by an adjustable self sealing cap. The spray manifold nozzles are automatically and correctly positioned to direct the hot water against the ware in the racks and this is accomplished when mounting the manifold in the dishwasher. The manifold has a smooth unobstructed interior that is coextensive with its length and this permits the manifold to be readily cleaned or examined when it is removed from the machine.

BRIEF DESCRIPTION OF THE DRAWING

FIG. 1 is a side elevation of the spray manifold and shows how it is removably supported in a dishwasher, a portion of the dishwasher being shown in section.

FIG. 2 is an enlarged transverse section through the rear portion of the spray manifold and is taken along the line 2—2 of FIG. 1. The novel means for supporting this rear manifold end is shown in elevation.

FIG. 3 is a longitudinal vertical section taken along the line 3—3 of FIG. 2 and shows the apparatus for connecting the manifold rear end to a hot water supply pipe and illustrates how the manifold spray nozzles are held at a desired angle for spraying the ware in the racks.

DESCRIPTION OF THE PREFERRED EMBODIMENT

In carrying out my invention I show in FIG. 1, a transverse section through a commercial dishwashing machine indicated generally at A. The machine has a dish-receiving compartment B, in which the ware may be washed, rinsed and sterilized. Since the novelty in the present invention lies in the particular shape of the spray manifold and the means for quickly mounting it in the compartment B, or removing it therefrom, I have not shown in detail how the ware is moved into and out from the compartment because this may be done by hand or by a mechanism. The rear wall 1 of the compartment B has a hot water inlet pipe C, and if the compartment is used for washing the ware, the hot water should be at a temperature of 140° F., and the detergent may be mixed with this hot water and then pumps, not shown, may be used for recirculating the wash water for a predetermined time period. On the other hand, if the compartment is used for rinsing and sterilizing the ware at a low temperature of 140° F., for the hot water, a sterilizing agent such as chlorine, is mixed with the hot water and the water is recirculated for a predetermined time period in the compartment. In my copending patent application on a Low Temperature Conveyor Rack-Type Dishwasher, Ser. No. 26,016, filed Apr. 2, 1979, I show the rinse compartment divided into two sections, the first section using hot rinse water at 140° F., for removing the detergent wash water from the ware and the second section using chlorine in the 140° F., rinse water for rinsing and sterilizing the ware.

I will now describe in detail the particular structure of the hot water inlet pipe C and the novel means for removably supporting the inlet end of a spray manifold shown at D, in FIGS. 1, 2 and 3. The hot water inlet pipe C, is arranged in a vertical position and is in communication with a source of hot water, not shown. The top of the hot water inlet pipe C, is closed at 4, see FIG. 3, and the front portion of the pipe has a hot water outlet opening 5 therein.

Figure 4:
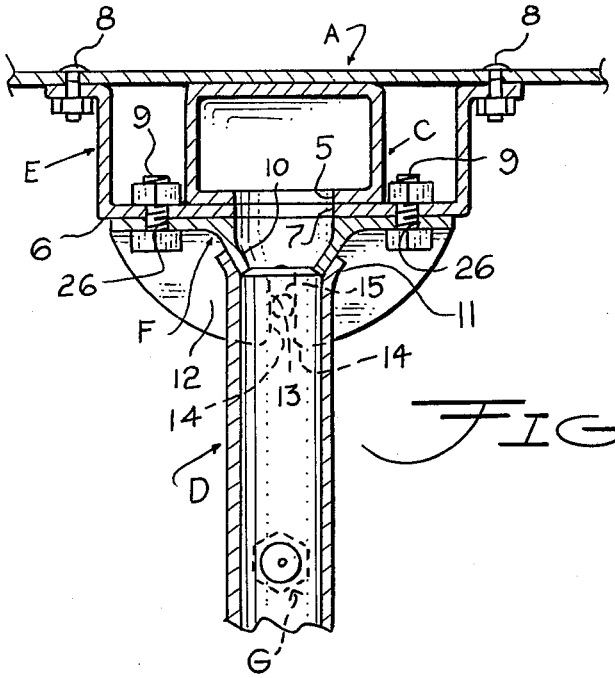
FIG. 4 is a horizontal longitudinal section taken along the line 4—4 of FIG. 3, and further illustrates how the spray manifold is held in the desired position so that the spray nozzles will direct hot water at the desired angle against the ware in the racks.

A U-shaped bracket E, see FIG. 2 and FIG. 4, has its web portion 6 extending across the front portion of the pipe C and it has an opening 7 that registers with the opening 5 in the inlet pipe. The bracket E, is secured to the wall 1 of the dishwasher A by bolts 8 or other suitable fastening means. A support F for the inlet end of the spray manifold D, is secured to the web portion 6 of the bracket E by bolts 9.

Both FIGS. 3 and 4 show the spray manifold support F provided with a conical-shaped outlet 10 that is in alignment with the openings 5 and 7 of the hot water inlet pipe C, and the bracket E, respectively. The inlet end of the spray manifold D has an outwardly flared portion 11 that receives the conical-shaped outlet 10 of the manifold support F, and makes a water tight seal therewith. The spray manifold has a plurality of jet nozzles G, arranged in a straight row and spaced from one another as shown in FIG. 1.

I provide novel cooperating means on the spray manifold support F, and the spray manifold D for arranging the row of jet nozzles G, in the proper angular position when the inlet end 11 of the spray manifold is coupled to the conical outlet 10 of the manifold support. The particular structure of the hot water pipe C, and the bracket E, may be altered without affecting one of the vital features in this invention. The point to keep in mind is that the support F for the inlet end of the spray manifold D, is anchored in a specific place in the compartment B of the dishwasher and the support F not only has a conical outlet 10 that is in communication with and receives hot water from the hot water inlet pipe C, but in addition, the support has an integral guide wing 12 shown in detail in FIGS. 3 and 4, that underlies a portion of the inlet end 11 of the spray manifold D. Also, the guide wing 12 has a central recess 13 with outwardly curved side edges 14 that will guide a pin 15, which depends from the manifold D, into the recess as clearly shown in FIG. 4. The center of the guide wing recess 13 lies in a vertical plane in which the longitudinal axis of the manifold D, also lies. The axes of the jet nozzles G, lie in the same vertical plane in which the pin 15 lies. The result is that the mere coupling of the flared inlet end 11 of the manifold D to the conical outlet 10 of the manifold support F will also properly align the row of jet nozzles G, at the correct angle because the coupling cannot be made until the pin 15 is received in the guide wing recess 13.

I have illustrated the spray manifold D, in FIGS. 3 and 4, as directing the hot water spray downwardly from the jets G, because in this case the manifold is positioned above the dish ware, not shown, in the compartment B. It is also possible to place this spray manifold D below the dish ware in the compartment and when this is done, the manifold support F, is rotated about the axis of the conical outlet 10 through a full 180° arc so that the guide wing recess 13 will be positioned above the manifold and the manifold will have to be rotated 180° on its axis for causing the pin 15 and the jet nozzles G to project upwardly and cause the jets G to point upwardly for causing the hot water to contact the dish ware from the underside. In actual practice there will be at least one spray manifold D placed above and one manifold placed below the dish ware for directing the hot water downwardly and upwardly against the dishes and my invention is broadly drawn to include both arrangements of the manifold or either one.

Figure 5:
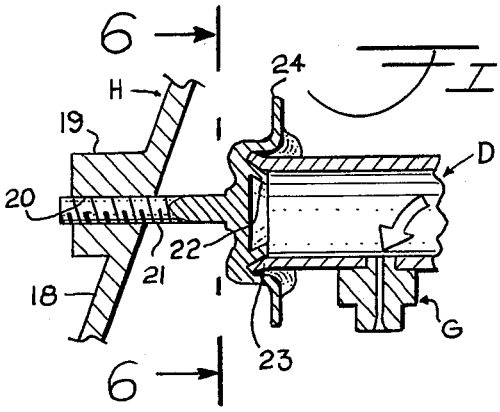
FIG. 5 is an enlarged vertical section of the front manifold end shown in FIG. 1, and illustrates how the self sealing cap for this front end also supports the manifold.
Figure 6:
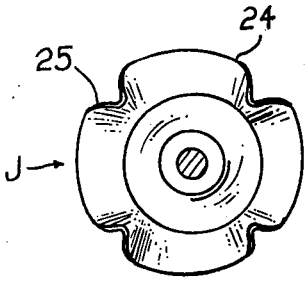
FIG. 6 is a front elevation of the closure cap and is taken along the line 6—6 of FIG. 5.

The apparatus for supporting and closing the front end of the spray manifold D, is shown in FIGS. 1 and 5. An arm H, is connected to the top 16 of the dish washer A by bolts 17 or other suitable fastening means. The arm has a downwardly inclined portion 18 and FIG. 5 shows this portion as having an integral boss 19 with a threaded bore 20 whose axis lies in a horizontal plane. A closure cap J, for the front end of the spray manifold D, has an axially aligned and integral threaded rod 21 that is received in the threaded bore 20 in the boss 19. The cap has a conical-shaped central portion 22 that protrudes from the interior of the cap and whose center is in alignment with the axis of the rod 21. This conical portion 22 is received in the outwardly flared front end 23 of the spray manifold D, and will make a liquid tight seal with the manifold as well as support it.

The cap J may be connected to or disconnected from the front end of the spray manifold D, without the need of any tools. The cap has an integral and outwardly flared skirt or rim 24 and this rim has scallops 25 therein to permit the operator's fingers to grip the rim for rotating the cap in one direction for connecting the cap to the front end of the manifold for closing and supporting the manifold or for rotating the cap in the opposite direction for freeing the cap from the manifold.

The axis of the threaded rod 21 of the closure cap J, is in horizontal alignment with the center of the conical outlet 10 of the manifold support F so that when the manifold D is supported at its outwardly flared forward end 23 by the closure cap J and is supported at its hot water inlet end by the conical outlet 10 of the manifold support F, the axis of the manifold will be in alignment with the axis of the threaded rod 21 and with the center of the conical outlet 10. In addition, the manifold D will have a water tight seal between the cap conical portion 22 on the cap and the outwardly flared forward end 23 of the manifold as well as have a water tight seal between the conical outlet 10 of the support for the inlet end of the manifold and the outwardly flared end 11 of the manifold. A rotation of the cap J, in one direction will accomplish this and will move the manifold against the conical outlet 10. Therefore a rotation of the cap in one direction will cause the manifold to be supported at both of its ends as well as water sealed at both of its ends. When the cap is rotated in the opposite direction, the spray manifold will be freed at both of its ends and may be removed for inspection and cleaning. The hollow cylindrical interior of the manifold is unobstructed throughout its entire length so that a cleaning brush or cloth can be used for cleaning purposes.

This is one of the novel features of my present invention and the other feature is the automatic aligning of the spray jets G, so that they will be held at the proper angle for spraying the hot water either downwardly against the dish ware or upwardly against them or both. It should be noted from FIGS. 2 and 4 that the support F, for the inlet end 11 of the spray manifold D, has arcuate-shaped slots 26 for receiving the shanks of the bolts 9. The center for these arcuate slots coincides with the axis of the opening 7 in the bracket E. It is possible with this structure to loose the bolts 9 and rotate the support F, clockwise or counterclockwise through a desired angle so as to swing the guide wing 12 and its guide slot 13 to the right or to the left of a vertical plane that extends through the common axis of the openings 5, 7 and 10. Now when the manifold D, is connected to the member F, the manifold must be rotated on its longitudinal axis to swing the pin 15 into alignment with the guide slot 13 whereupon the manifold can be moved to cause the pin 15 to enter the guide slot. In this simple manner, the nozzles G on the manifold D will be inclined at the desired angle.

I claim:

1. The combination with a dishwasher having a water inlet pipe with a water outlet opening and including:

(a) a first support for the inlet end of a spray manifold and having a conical outlet portion registering with the outlet opening in the pipe, the inlet end of the spray manifold being outwardly flared and adapted to receive said conical outlet portion and form a water tight seal therewith so that water flowing through the pipe outlet will enter the spray manifold;

(b) a second support for the opposite open end of said spray manifold and including a closure cap, said cap having a conical portion for entering an adjacent outwardly flared open end of said spray manifold; and (c) means for moving said cap into sealing connection with the adjacent end of said manifold and for moving the manifold so that its inlet end is brought into a sealing connection with the outlet opening of said water inlet pipe.

2. The combination as set forth in claim 1: and in which (a) the support for the inlet end of the spray nozzle includes a member having a guide wing positioned adjacent to the outer surface of the inlet end of said spray manifold, said member having a recess whose length parallels the longitudinal axis of said manifold, said spray manifold having a radially extending pin receivable in the recess when said means moves the cap and manifold so that both ends of the manifold are supported, said manifold having a plurality of in-line jet nozzles spaced from each other whose common plane for the nozzle axes also includes the pin axis.

3. The combination as set forth in claim 2: and in which (a) said member with its guide wing and recess being angularly adjustable about the center of the conical opening in the water inlet pipe for swinging the guide wing and recess for inclining the spray manifold pin at an angle for positioning the axes of the jet nozzles at the same angle.

4. In a dishwasher having a water inlet pipe with an outlet opening therein, a cylindrical spray manifold having first and second outwardly flared open ends and at least one spray nozzle extending therefrom, a first manifold support having an opening therethrough communicating with said pipe opening and having a conical extension about the support opening for fitting into the first flared end of said spray manifold in mating relation thereto to form a water tight seal therewith, a second manifold support including a closure cap having a conical extension for fitting into the second flared end of said spray manifold in mating water tight relation thereto for sealing the second end so that water entering the first end passes through said spray nozzle, and mounting means for said second support including means adjustably urging said cap axially of said spray manifold to seal the ends of the spray manifold to said conical extensions and to release said spray manifold for removal.

5. The combination of claim 4 further defined by said first support having means defining a slot parallel to the axis of the conical extension about said support opening and said spray manifold having a radial pin at said first end in predetermined relation to the axis of said spray nozzle for sliding into said slot as said spray manifold is urged onto said first support, and said closure cap having a threaded axial stem extending rearwardly from the conical extension and adapted to extend through a threaded portion of said mounting means whereby rotation of said cap will tighten or loosen the engagement thereof with said spray manifold.

* * * * *